US007699677B2

(12) United States Patent
Yoshida et al.

(10) Patent No.: US 7,699,677 B2
(45) Date of Patent: Apr. 20, 2010

(54) PROFILING FLOAT AND USAGE OF THE PROFILING FLOAT

(75) Inventors: Masahiro Yoshida, Kanagawa (JP); Kensuke Takeuchi, Kanagawa (JP); Yoshifumi Kuroda, Kanagawa (JP); Nobuyuki Shikama, Kanagawa (JP); Kentaro Ando, Kanagawa (JP); Taiyo Kobayashi, Kanagawa (JP); Shigeki Hosoda, Kanagawa (JP)

(73) Assignee: Independent Administrative Institution, Japan Agency for Marine-Earth Science and Technology, Yokosuka-shi (JP)

( * ) Notice: Subject to any disclaimer, the term of this patent is extended or adjusted under 35 U.S.C. 154(b) by 144 days.

(21) Appl. No.: 11/793,973

(22) PCT Filed: Dec. 8, 2005

(86) PCT No.: PCT/JP2005/022542

§ 371 (c)(1),
(2), (4) Date: Oct. 29, 2007

(87) PCT Pub. No.: WO2006/070577

PCT Pub. Date: Jul. 6, 2006

(65) Prior Publication Data

US 2008/0087209 A1 Apr. 17, 2008

(30) Foreign Application Priority Data

Dec. 28, 2004 (JP) ..... 2004-379500

(51) Int. Cl.
*B63B 22/20* (2006.01)

(52) U.S. Cl. ..... 441/29

(58) Field of Classification Search ..... 441/29; 73/170.34, 170.29
See application file for complete search history.

(56) References Cited

U.S. PATENT DOCUMENTS 5,291,847 A * 3/1994 Webb ..... 114/331
6,807,856 B1 * 10/2004 Webb ..... 73/170.29

FOREIGN PATENT DOCUMENTS

| | | | |
|---|---|---|---|
| JP | 57-2600 | B2 | 1/1982 |
| JP | 59-167977 | U | 11/1984 |
| JP | 61-53296 | U | 4/1986 |
| JP | 62-71391 | U | 5/1987 |
| JP | 63-162699 | U | 10/1988 |
| JP | 5-278681 | A | 10/1993 |
| JP | 2001-247086 | A | 9/2001 |
| JP | 2002-145177 | A | 5/2002 |

* cited by examiner

*Primary Examiner*—Ed Swinehart
(74) *Attorney, Agent, or Firm*—Frishauf, Holtz, Goodman & Chick, P.C.

(57) ABSTRACT

Provided is a profiling float that can minutely and surely control effective buoyancy acting on the float in itself, and usage of the profiling float.

The profiling float according to the present invention is equipped with a float chamber forming an airtight internal space, a fluid storage part provided in the float chamber and storing a fluid for control of buoyancy, a bladder provided at the exterior of the float chamber, in the interior of which the fluid for control of buoyancy is filled to change a volume thereof, thereby controlling buoyancy acting on the profiling float, a pump mechanism for transferring the fluid for control of buoyancy between the bladder and the fluid storage part, and a driving source for driving the pump mechanism, wherein the pump mechanism is composed of a gear pump.

20 Claims, 3 Drawing Sheets

- PRIOR ART -

PROFILING FLOAT AND USAGE OF THE PROFILING FLOAT

This application is a U.S. National Phase Application under 35 USC 371 of International Application PCT/JP2005/022542 filed Dec. 8, 2005.

TECHNICAL FIELD

The present invention relates to a profiling float used in, for example, a high-performance marine monitoring system and usage of the profiling float.

BACKGROUND ART

In recent years, it has been necessary to clarify and grasp environmental variation mechanisms, for example, a mechanism of heat transport in ocean, on a global scale in order to cope with environmental problems such as global warming. A high-performance marine monitoring system for that purpose is being pushed forward. In such a high-performance marine monitoring system, it is necessary to monitor vertical structures of, for example, physical parameters such as sea temperatures and chemical parameters such as salinity concentrations from a sea depth of about 2,000 m to a sea level, i.e., changes in various parameters in a direction of the depth of the sea. As an instrument for conducting such monitoring, is used an automatic control profiling float that can automatically control its own buoyancy according to a preset program, thereby permitting lifting movement, lowering movement and maintenance of a position in a vertical direction in the sea.

As a conventional profiling float, is known, for example, a float having a structure illustrated in FIG. 3.

In the example illustrated in FIG. 3, a profiling float 50 is equipped with, as a housing, a float chamber 51 made of, for example, a reinforced resin, which forms an airtight internal space, and is constructed by a buoyancy controlling mechanism 52 for controlling the degree of buoyancy acting on the whole of the profiling float 50, a measuring mechanism 53 for measuring various parameters in the sea, a data transmitting mechanism 54 for radio-transmitting the data obtained by the measuring mechanism 53, a control mechanism 55 for controlling these respective mechanisms and an electric power source device 56 for supplying a power source to these respective mechanisms.

The buoyancy controlling mechanism 52 is equipped with a fluid storage part 521 storing a fluid for control of buoyancy in the interior thereof, which is provided in the interior of the float chamber 51, and an elastically expandable and contractible bag-like bladder 522 provided in such a manner that an acting part thereof is located at the exterior of the float chamber 51. In the buoyancy controlling mechanism 52, the bladder 522 is connected to the fluid storage part 521 through a main passage 523A having a one-way transfer type pump device 524 for transferring the fluid for control of buoyancy, and a return passage leading to the fluid storage part 521 is formed by a branched passage 523B branched from the main passage 523A. This branched passage 523B is provided with a valve mechanism 525 controlling a flow rate of the fluid for control of buoyancy according to the degree of valve opening. Here, the one-way transfer type pump device means an irreversible pump device, which has a function of transferring a fluid only one direction from one to the other in the main passage 523A and cannot transfer the fluid in a reverse direction. The operation of the pump device is stopped, whereby the main passage 523A is in a closed state.

The measuring mechanism 53 is constructed by a sensor 531, for example, a conductivity-temperature-depth profiler (CTD Profiler), which is provided in an exposed state at the exterior of the float chamber 51, and a sensor circuit board 532 for controlling the sensor 531. The data transmitting mechanism 54 is constructed by a radio antenna 541, a part of which is provided in an exposed state at the exterior of the float chamber 51, and a transmission circuit board 542. The sensor circuit board 532 and the transmission circuit board 542 are electrically connected to the control mechanism 55.

A mass to volume ratio of the whole of the profiling float 50 is designed in such a manner that a value of effective buoyancy in the sea becomes negative, and the float sinks in a state that the fluid for control of buoyancy is not filled at all or scarcely filled in the interior of the bladder 522 and the volume thereof is minimum and in a minimum effective buoyancy state that the buoyancy acting on the profiling float 50 is minimum.

In the present description, the term "effective buoyancy" means a value obtained by [Buoyancy acting on the profiling float in water]—[The overall mass of the profiling float]. Accordingly, when the value of the effective buoyancy is negative, the profiling float moves downward in the sea. When the value of the effective buoyancy is positive, the profiling float moves upward in the sea. When the value of the effective buoyancy is zero, the profiling float stays in a vertical direction so as to keep a fixed depth in the sea.

The profiling float 50 having such construction as described above is generally thrown in the sea from, for example, a ship and subjected to observation. After thrown in the sea, regarding, for example, a series of operations that the float moves downward to a predetermined depth, drifts at this depth for a fixed period of time and then gradually moves upward to a sea level as a cycle, the profiling float 50 automatically executes this cycle in a preset period to measure various parameters in this process. For example, measured data obtained during the upward movement in the sea is radio-transmitted to a base station when the profiling float 50 surfaces on the sea level.

More specifically, the profiling float 50 thrown in the sea starts to move downward by closing the main passage 523A by the pump device 524 in a stopped state and closing the branched passage 523B by the valve mechanism 525 in a state that the fluid for control of buoyancy is not present at all or scarcely present in the interior of the bladder 522, thereby creating the above-described minimum effective buoyancy state.

When drive of the pump device 524 is started by a signal according to a proper program preset in the control mechanism 55 in this minimum effective buoyancy state, the fluid for control of buoyancy is supplied from the fluid storage part 521 to the bladder 522 through the main passage 523A, whereby the bladder 522 is elastically expanded according to the amount of the fluid for control of buoyancy supplied to gradually increase the effective buoyancy of the profiling float 50. As a result, the downward movement of the profiling float 50 is gradually slowed.

When the value of the effective buoyancy becomes zero, the drive of the pump device 524 is stopped, and the bladder 522 is kept in a state expanded according to the volume of the fluid for control of buoyancy, which is present in the interior of the bladder, whereby the profiling float 50 becomes a neutral buoyancy state that the effective buoyancy is zero. As a result, the profiling float 50 stays in a vertical direction so as to keep the depth in the sea.

When the fluid for control of buoyancy is continuously filled into the bladder 522 to further expand the bladder 522, the effective buoyancy is gradually increased, and the profiling float 50 starts to move upward in the sea when the value of the effective buoyancy becomes positive.

On the other hand, when the branched passage 523B is then opened by the valve mechanism 525 in the state that the drive of the pump device 524 has been stopped, the fluid for control of buoyancy existing in the bladder 522 is discharged into the fluid storage part 521 through the branched passage 523B by the elastic restoring force of the bladder 522 and external force applied to the bladder 522 from the outside, for example, seawater pressure, whereby the bladder 522 is contracted to reduce the volume thereof so as to lower the effective buoyancy. As a result, the profiling float 50 moves downward again in the sea when the value of the effective buoyancy becomes negative.

In other words, according to such a profiling float 50 as described above, the volume of the fluid for control of buoyancy filled into the interior of the bladder 522 is controlled, whereby the volume of the bladder 522 is controlled, so that changes in the effective buoyancy attending on the changes in the volume of the bladder 522 permit the profiling float to move upward, move downward and stay in the vertical direction in the sea.

In such a profiling float for observation as described above, it is necessary to minutely control the effective buoyancy of the profiling float for controlling a predetermined moving speed and a stay depth with high accuracy. Such control of the effective buoyancy is achieved by minutely controlling the volume of bladder, i.e., the volume of the fluid for control of buoyancy existing in the interior of the bladder, by the pump device 524 and the valve mechanism 525.

In the profiling float 50 having such construction as described above, the same degree of pressure as the seawater pressure applied to the bladder 522 is applied to the valve mechanism 525 through the fluid for control of buoyancy. However, the valve mechanism 525 is difficult from the mechanism thereof to strictly control the degree of opening of the valve under pressure. After all, it is difficult to minutely control the flow rate of the fluid for control of buoyancy discharged from the bladder 522, so that it is difficult to minutely control the amount of the fluid for control of buoyancy within the bladder 522. Accordingly, the profiling float involves a problem that the predetermined effective buoyancy value can be realized with high accuracy, and after all, it is actually very difficult to realize the predetermined moving speed of the profiling float 50 and the operation in the sea such as the staying in the vertical direction at the predetermined depth with high accuracy. In addition, the float involves a problem that since the pressure applied to the valve mechanism 525 is considerably high when the profiling float 50 is located at a deep depth in particular, the above-described problem becomes more marked.

In addition, the valve mechanism 525 involves a problem that the amount of the fluid for control of buoyancy passing through the valve mechanism 525 varies according to, for example, the pressure applied to the fluid for control of buoyancy even when the degree of opening of the valve is kept constant, so that the amount is not fixedly stabilized, and after all, it is difficult to accurately control the flow rate of the fluid for control of buoyancy.

Patent Art. 1: Japanese Patent Application-Laid-Open No. 2002-145177.

DISCLOSURE OF THE INVENTION

The present invention has been made on the basis of the foregoing circumstances and has as its object the provision of a profiling float that can minutely and surely control effective buoyancy acting on the float in itself, and usage of the profiling float.

The profiling float according to the present invention is a profiling float comprising a float chamber forming an airtight internal space, a fluid storage part provided in the float chamber and storing a fluid for control of buoyancy, a bladder provided at the exterior of the float chamber, in the interior of which the fluid for control of buoyancy is filled to change a volume thereof, thereby controlling buoyancy acting on the profiling float, a pump mechanism for transferring the fluid for control of buoyancy between the bladder and the fluid storage part, and a driving source for driving the pump mechanism, wherein the pump mechanism is composed of a gear pump.

In the profiling float according to the present invention, a valve mechanism for controlling the transfer of the fluid for control of buoyancy between the fluid storage part and the bladder may preferably be provided.

In the profiling float, the gear pump may preferably have a performance-guaranteed driving speed of 10 to 150 revolutions/min.

In the profiling float, the gear pump may preferably have a fluid transferring capacity of 4.5 to 100 cc/min.

In the profiling float, the driving source of the pump mechanism may preferably be a direct current motor.

In the profiling float, the fluid for control of buoyancy may preferably have a viscosity of at least 3,000 cst at 2° C.

The profiling float may preferably be equipped with measuring means for measuring pressure and at least one water-related information, and the measuring means preferably can measure meteorological information.

The usage of a profiling float according to the present invention is usage of the above-described profiling float, wherein the amount of the fluid for control of buoyancy within the bladder is controlled on the basis of at least the pressure information obtained by the measuring means.

According to the profiling float of the present invention, both of amounts of the fluid for control of buoyancy discharged from and supplied to the bladder are actively controlled by the gear pump that is a reversible type pump, whereby the amounts of the fluid for control of buoyancy supplied to and discharged from the bladder can be accurately controlled. As a result, the volume of the fluid for control of buoyancy existing within the bladder is surely controlled. Accordingly, the volume of the bladder is minutely controlled, and consequently the effective buoyancy of the profiling float is controlled with high accuracy.

The gear pump is used in combination with the fluid for control of buoyancy having a relatively high viscosity as described above, whereby a braking function is basically exhibited, so that an unintended operation is surely prevented even under such environment as a high pressure is applied to the fluid for control of buoyancy, and the rotational angle and rotational speed of the gear are accurately controlled. Accordingly, the amount of the fluid transferred is always controlled with high accuracy. As a result, the volume of the bladder is always minutely controlled, and after all the buoyancy of the profiling float is controlled with high accuracy.

Since the gear pump is of a small size and lightweight compared with the conventional one-way transfer type pump, the miniaturization and weight saving of the whole profiling float can be realized. As a result, the high efficiency of the electric power consumed by the profiling float can be achieved, and so a long service life is realized, and moreover a high degree of freedom is achieved in design conditions such as the form of the float chamber.

In addition, according to the construction that the valve mechanism is provided, the transfer of the fluid for control of buoyancy between the fluid storage part and the bladder is controlled with high accuracy, so that the volume of the bladder is surely controlled, and after all the buoyancy of the profiling float is controlled with high accuracy.

According to the usage of the profiling float according to the present invention, the amount of the fluid for control of buoyancy filled into the bladder is controlled on the basis of various kinds of information, for example, a conductivity (salinity concentration) of seawater, a seawater temperature and a seawater pressure, whereby the position of the profiling float can be controlled to the predetermined depth position relevant to the information.

DESCRIPTION OF CHARACTERS

Figure 1:
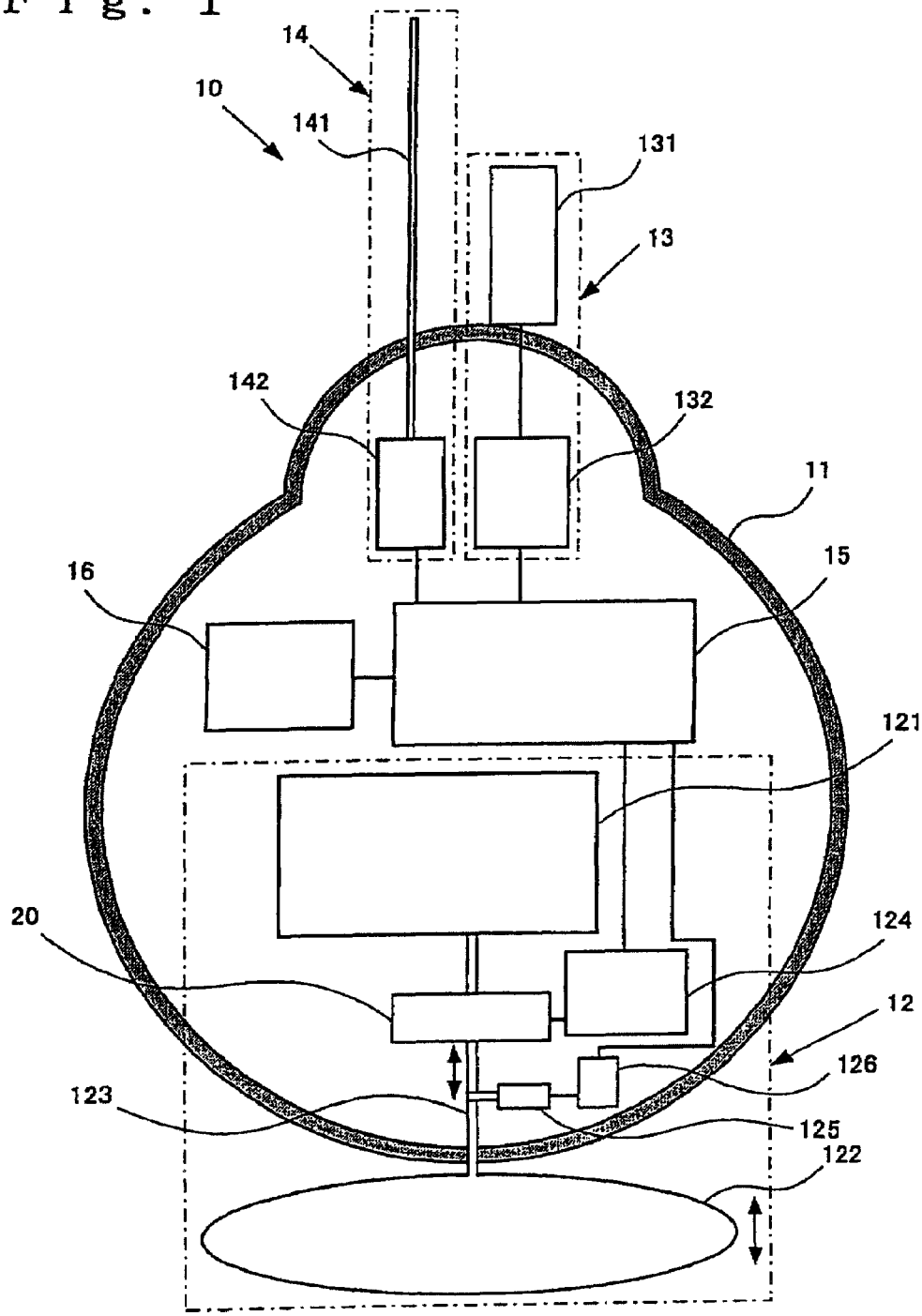
[FIG. 1] is a cross-sectional view illustrating the construction of an exemplary profiling float according to the present invention taken along a major axis of a float chamber.

10 Profiling float
11 Float chamber
12 Buoyancy controlling mechanism
121 Fluid storage part
122 Bladder
123 Communicating passage
124 Driving source
125 Valve mechanism
126 Valve mechanism-driving source
13 Measuring mechanism
131 Sensor
132 Sensor circuit board
14 Data transmitting mechanism
141 Radio antenna
142 Transmission circuit board
15 Control mechanism
16 Electric power source device
20 Gear pump
201 Gear case
202*a* Internal residence space
202*b* External residence space
203 Driving shaft
204 Driving gear
205 Meshing portion
206 Driven shaft
207 Driven gear
208 Internal opening
209 External opening
210 Transfer space
50 Profiling float
51 Float chamber
52 Buoyancy controlling mechanism
521 Fluid storage part
522 Bladder
523A Main passage
523B Branched passage
524 Pump device
525 Valve mechanism
53 Measuring mechanism
531 Sensor
532 Sensor circuit board
54 Date transmitting mechanism
541 Radio antenna
542 Transmission circuit board
55 Control mechanism
56 Electric power source device

MODE FOR CARRYING OUT THE INVENTION

The profiling float according to the present invention will hereinafter be described in detail.

Figure 2:
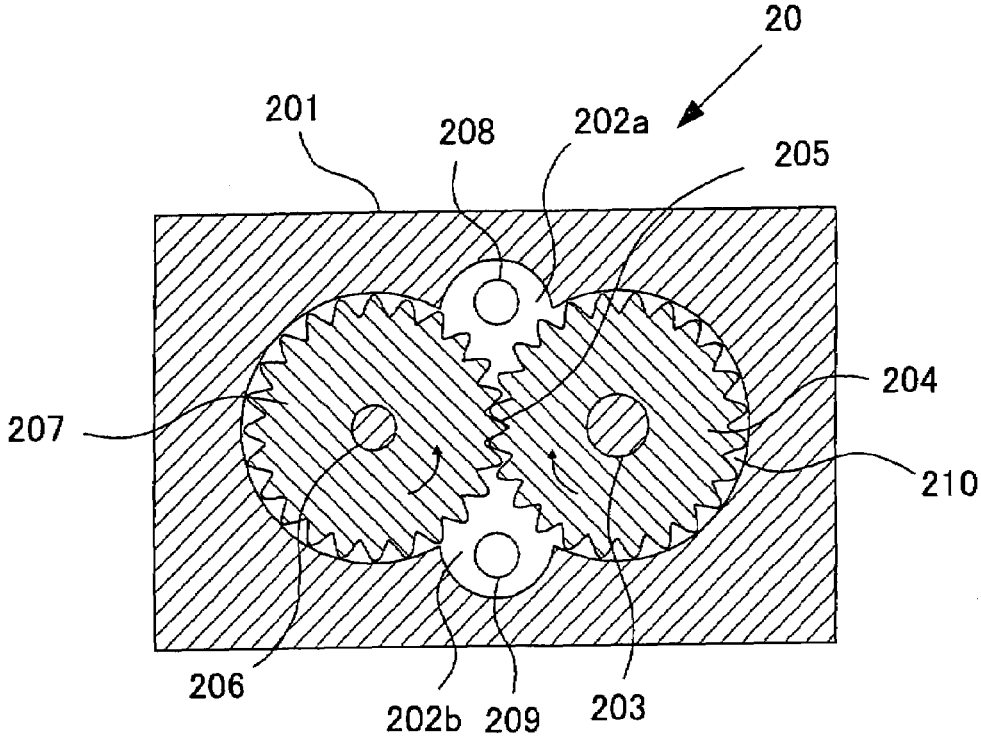
[FIG. 2] is a cross-sectional view illustrating the construction of a gear pump in a section perpendicular to a rotational shaft of the gear.
Figure 3:
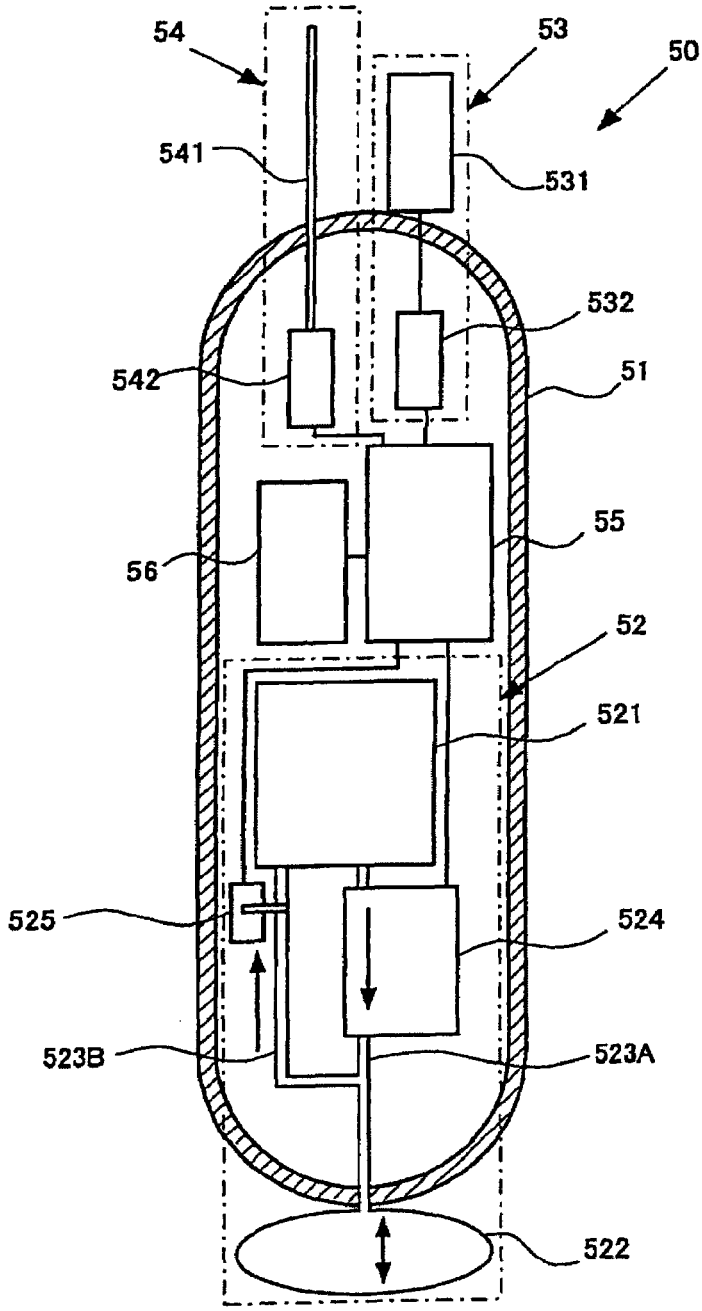
[FIG. 3] is a cross-sectional view illustrating the construction of an exemplary conventional profiling float taken along a vertical axis.

FIG. 1 is a cross-sectional view illustrating the construction of an exemplary profiling float according to the present invention taken along a major axis of a float chamber, and FIG. 2 is a cross-sectional view illustrating the construction of a gear pump in a section perpendicular to a rotational shaft of the gear.

In the embodiment illustrated, the profiling float 10 is equipped with, as a housing, a substantial sphere-type float chamber 11 made of, for example, a reinforced resin, which forms an airtight internal space, and is constructed by a buoyancy controlling mechanism 12 for controlling the degree of buoyancy acting on the whole of the profiling float 10, a measuring mechanism 13 for measuring various kinds of information, including a seawater pressure, in the sea, a data transmitting mechanism 14 for radio-transmitting the electronic data obtained by the measuring mechanism 13, a control mechanism 15 for controlling these respective mechanisms and an electric power source device 16 for supplying a power source to these respective mechanisms.

In the above profiling float, the measuring mechanism 13 preferably can measure at least one water-related information together with a seawater pressure, and further preferably can measure at least one meteorological information.

In the present description, the water-related information includes various parameters measurable in relation to the sea water. As specific examples thereof, may be mentioned physical parameters, for example, a conductivity (salinity concentration) of seawater and a seawater temperature, biological and chemical parameters, for example, a chlorophyll concentration and dissolved concentrations of water-soluble gases such as oxygen and carbon dioxide, and optical parameters, for example, transparency of seawater.

The meteorological information includes various parameters measurable in relation to the air. As specific examples thereof, may be mentioned physical parameters, for example, an air temperature, a humidity and an atmospheric pressure, and chemical parameters, for example, concentrations of various compositional gases.

No particular limitation is imposed on the form of the float chamber 11. For example, in the embodiment illustrated in FIG. 1, the float chamber is formed with a semi-spherical dome integrally composed on the top of a spherical body. The housing is formed in such a form, whereby not only the profiling float 10 can be miniaturized as a whole, but also effects that excellent pressure resistance is achieved, and moreover the positional control of the profiling float is easy because the resistance of the seawater is substantially uniform upon the movement of the float in all of vertical and lateral directions are exhibited. To shape the float chamber 11 in this form has been able to be realized as a result that the miniaturization and weight saving of the whole buoyancy controlling mechanism 12 in the profiling float 10 has been achieved by adopting a gear pump as a pump device as described below.

The buoyancy control mechanism 12 is constructed by a fluid storage part 121 storing a fluid for control of buoyancy in the interior thereof, which is provided in the interior of the float chamber 11, a bladder 122 provided at the exterior of the float chamber 11 and composed of a deformable part, which is elastically expandable and contractible according to the amount of the fluid for control of buoyancy filled into the interior thereof and formed of an elastic member, a gear pump 20 provided intervening in a communicating passage 123 directly connecting the fluid storage part 121 to the bladder 122, a driving source 124 provided so as to directly link to the gear pump 20 for driving the gear pump 20, a valve mechanism 125 for changing over opening and closing states of the communicating passage 123, and a valve mechanism-driving source 126 for driving the valve mechanism 125.

In the present invention, as the bladder 122, may be used that having proper form and construction capable of controlling the effective buoyancy of the profiling float 10. The volume of the bladder 122 is determined according to the mass to volume ratio of the whole profiling float 10, or the like. For example, the volume of the bladder 122 is 0.3 to 10%, particularly 0.5 to 4% based on the occupied volume of the profiling float 10.

As the fluid for control of buoyancy, may be used that having various compositions and physical properties. However, the viscosity thereof is preferably at least 3,000 cst, more preferably 3,000 to 20,000 cst, particularly preferably 10,000 cst at 2° C. The specific gravity of the fluid for control of buoyancy is preferably, for example, 0.85 to 1.0. As specific preferable examples of the fluid for control of buoyancy, may be mentioned oils usable as gear oil, for example, silicone oil, and particularly silicone oil having a viscosity of 10,000 cst at 2° C. By using the fluid for control of buoyancy having such a specific physical property, suitable lubricity is achieved in the gear pump 20 having the construction, which will be described subsequently, and moreover the liquid-tightness of the gear pump 20 is improved to surely guarantee high transfer accuracy of the fluid.

The gear pump 20 is constructed by having a driving gear 204 provided rotatably on a driving shaft 203 directly linked to the driving source 124 in a gear case 201 as illustrated in FIG. 2, and a driven gear 207 meshed with the driving gear 204 at a meshing portion 205 and provided so as to rotate on a driven shaft 206 following the rotation of the driving gear 204. An internal opening 208 communicating with the fluid storage part 121 through the communicating passage 123 is provided in an internal residence space 202*a* formed on an upstream side from the meshing portion 205 in a right rotating direction indicated by arrows, and an external opening 209 communicating with the bladder 122 through the communicating passage 123 is provided in an external residence space 202*b* formed on a downstream side from the meshing portion 205 in the rotating direction.

In the above-described gear pump 20, a minimum fluid transfer unit defined by a volume of one transfer space 210 partitioned by a space and an inner peripheral wall surface of the gear case is 5.8 to 23 μl, particularly 10 to 15 μl. By having such a fluid transfer unit, the amount of the fluid for control of buoyancy transferred can be minutely controlled.

The gear pump 20 has high pressure resistance of, for example, 0 to 70 MPa. According to such a gear pump 20, the amount of the fluid for control of buoyancy transferred can be controlled with high accuracy irrespective of the transferring direction thereof even when a high pressure is applied through, for example, the external opening 209.

In the gear pump 20 of the above-described construction, other design elements, for example, gear diameters of the driving gear 204 and driven gear 207, the number of gear teeth, tooth thickness, and the depth of the space, may be determined according to the rotational speed in driven state, the physical properties of the fluid for control of buoyancy and the flow rate of the fluid for control of buoyancy required. Such a gear pump 20 may be designed so as to have a fluid transferring capacity of 4.5 to 100 cc/min, preferably 20 to 50 cc/min.

The gear pump 20 preferably has a performance-guaranteed driving speed of 10 to 150 revolutions/min, particularly 10 to 100 revolutions/min, by which action and effect from the viewpoint of design are surely exhibited.

No particular limitation is imposed on the driving source 124 for driving the gear pump 20 so far as it has performance that the torque is 3.5 Nm, and the performance-guaranteed driving speed is 10 to 150 revolutions/min by way of example, and as examples thereof, may be mentioned direct current motors and alternating current motors each equipped with a speed changer. As specific preferable examples of the driving source 124, may be mentioned direct current motors each equipped with a speed changer, particularly direct current motors, the driving power of which is 8 to 20 V, and which are each equipped with a speed changer.

No particular limitation is imposed on the constructions of the valve mechanism 125 and valve mechanism-driving source 126 so far as proper pressure resistance is realized, and the transfer of the fluid for control of buoyancy can be ON-OFF controlled by changing over the opening and closing states of the communicating passage 123, and publicly known various-those may be used.

In the above-described profiling float 10, the measuring mechanism 13 is constructed by a sensor 131 provided in an exposed state at the exterior of the float chamber 11 and including plural kinds of sensor instruments, for example, a conductivity-temperature-depth profiler (CTD) and a barometer as needed, and a sensor circuit board 132 storing the data obtained by the sensor 131 and controlling the sensor 131. The data transmitting mechanism 14 is constructed by a radio antenna 141, a part of which is provided in an exposed state at the exterior of the float chamber 11, and a transmission circuit board 142. The sensor circuit board 132 and the transmission circuit board 142 are connected to the control mechanism 15.

In the profiling float 10 having the above-described construction, the valve mechanism 125 is changed over to a opened state by the valve mechanism-driving source 126 according to a control signal from the control mechanism 15, and the driving gear 204 of the gear pump 20 is rotationally driven in, for example, a right direction (direction of the arrow in FIG. 2) by the driving source 124, whereby the driven gear 207 is rotated following the rotation of the driving gear 204. As a result, the fluid for control of buoyancy present in the internal residence space 202*a* is transferred to the external residence space 202*b* by a plurality of transfer spaces 210 each formed between a space of the driving gear 204 or driven gear 207 and the inner peripheral wall surface of the gear case 201 and moving in a circumferential direction following the rotational movement of the driving gear 204 and driven gear 207. A new fluid for control of buoyancy is supplied within the internal residence space 202*a* from the fluid storage part 121 by a negative pressure in the internal residence space 202*a* generated as a result of this.

On the other hand, the fluid for control of buoyancy transferred to the external residence space 202*b* is supplied under pressure to the bladder 122 through the external opening 209, whereby the bladder 122 is expanded according to the volume of the fluid for control of buoyancy supplied to increase the volume. As a result, the buoyancy acting on the profiling float 10 is increased.

the driving gear 204 of the gear pump 20 is rotationally driven in a reverse direction by the driving source 124, whereby the fluid for control of buoyancy is discharged from the bladder 122 to the fluid storage part 121, whereby the bladder 122 is contracted according to the volume of the fluid for control of buoyancy discharged to decrease the volume of the bladder. As a result, the buoyancy acting on the profiling float 10 is reduced.

The buoyancy acting on the profiling float 10 is increased or decreased as described above, whereby the profiling float 10 moves upward in the sea water when the value of the effective buoyancy is positive, while the profiling float 10 moves downward in the sea water when the value of the effective buoyancy is negative. Further, the profiling float 10 stays in a vertical direction so as to keep a fixed depth when the value of the effective buoyancy is zero. When the gear pump 20 is stopped, and the valve mechanism 125 is closed by the valve mechanism-driving source 126, the communicating passage 123 is closed, whereby the amount of the fluid for control of buoyancy within the bladder 122 is retained. Accordingly, the effective buoyancy at the time the gear pump 20 has been stopped and the valve mechanism 125 has been closed is retained as it is, and the operation state of the profiling float 10 according to the value of the effective buoyancy is continuously retained.

As described above, the bladder 122 is elastically expanded or contracted according to the amount of the fluid for control of buoyancy forcedly supplied or discharged by the gear pump 20, whereby the volume of the bladder is changed. The overall volume of the profiling float 10 can be thereby changed to control the effective buoyancy of the profiling float 10.

Such a profiling float 10 as described above is subjected to observation in a mode that a series of the following operations (1) to (4) is regarded as a cycle, and this cycle is automatically executed many times in a proper period preset. Here, the observation may be continuously conducted as long as the supply of the electric power by the electric power source device 16 is allowed.

(1) operation that the effective buoyancy is made negative to move downward in the sea;

(2) operation that the effective buoyancy is made zero to stop movement in a vertical direction so as to keep a depth at the predetermined depth, and then stand by while drifting at this depth;

(3) operation that the value of the effective buoyancy is made positive after a preset period has elapsed to move upward to a sea level at a predetermined speed while conducting measurement of one or more parameters by the sensor 131; and (4) operation that the data obtained during the upward movement is radio-transmitted by the data transmitting mechanism 14 in a state that the state surfaced on the sea level has been retained.

The profiling float 10 may also be subjected to observation in a mode that a series of the following operations (a) to (e) is regarded as a cycle, and this cycle is automatically executed many times in a proper period preset.

(a) operation that the effective buoyancy is made negative to move downward in the sea at a predetermined speed while conducting measurement of one or more parameters by the sensor 131;

(b) operation that a target depth is determined on the basis of one or more parameter values obtained by the sensor 131, and the effective buoyancy is made zero to stop movement in a vertical direction so as to keep the target depth;

(c) operation that the measurement of one or more parameters is continuously or intermittently conducted to determine a newest target depth on the basis of the newest parameter values obtained by the measurement, the effective buoyancy is made negative or positive when the newest target depth is different from the depth, at which the parameter values have been measured, to move to the newest target depth, and the effective buoyancy is then made zero to stop movement in a vertical direction so as to keep the newest depth;

(d) operation that after the operation (c) is conducted repeatedly for a preset period, the value of the effective buoyancy is made positive to move upward to a sea level; and (e) operation that the expected data obtained during the measurement operation is radio-transmitted by the data transmitting mechanism 14 in a state that the state surfaced on the sea level has been retained.

According to the usage of the profiling float 10 by the above-described cycle of from (a) to (e), a boundary of a thermocline or pycnocline can be traced in a plane direction along the sea level with high accuracy, for example, even in the case where the thermocline or pycnocline is formed over a wide depth region.

In the above-described observation cycle, when the sensor 131 can measure at least one meteorological information, the profiling float may also execute an operation that said at least one meteorological information is measured in the state surfaced on the sea level in the observation cycle to radio-transmit this information by the data transmitting mechanism 14.

According to the profiling float of the present invention, both supply and discharge of the fluid for control of buoyancy to and from the bladder are conducted by the gear pump that is a reversible type pump, so that the control of both amounts of the fluid for control of buoyancy supplied to and discharged from the bladder is basically forcedly executed without being affected by other external force, for example, seawater pressure. Accordingly, the volume of the fluid for control of buoyancy existing within the bladder can be surely controlled. In addition, since the amount and speed of the fluid for control of buoyancy transferred by the gear pump are determined on the basis of the rotational angle and rotational speed of the gear, which can be electrically controlled with high accuracy, the amount of the fluid for control of buoyancy transferred can be minutely controlled, and after all the effective buoyancy of the profiling float can be minutely and surely controlled. Accordingly, the changeover of the profiling float between upward movement and downward movement and the alteration of moving speed thereof can be executed in a superior responsive speed and accurately.

The gear pump is used in combination with the fluid for control of buoyancy having a relatively high viscosity as already described above, whereby a braking function is basically exhibited. The gear pump is thereby operated in a mode that, for example, the rotational direction and rotational angle are surely controlled on the basis of a driving signal even when a high pressure is applied to the fluid for control of buoyancy. Accordingly, the amount of the fluid for control of buoyancy transferred can be controlled with high accuracy even when a great pressure difference is made between an upstream side and a downstream side with the gear pump between.

The profiling float according to the present invention is provided with the valve mechanism, whereby the opening and closing states of the communicating passage can be surely changed over, thereby surely controlling the transfer of the fluid for control of buoyancy. In addition, there is no need of independently providing a return passage of the fluid for control of buoyancy from the bladder to the fluid storage part, and so the buoyancy controlling mechanism can be simply constructed as a whole.

According to the above-described gear pump, a high lubricating effect is achieved by using, as the fluid for control of buoyancy, an oil having a high viscosity as described above, and liquid leakage or the like, which is caused by fine interstices present in the gear pump, is prevented, so that the flow control of the fluid for control of buoyancy can be surely achieved.

Here, a gear pump is generally driven and used at a relatively high rotational speed of, for example, 800 to 4,000 revolutions/min by an alternating current driving means of, for example, 100 to 200 V, and designing numerical values relating to the construction thereof are determined on the premise that the pump is driven under the service conditions generally used. Accordingly, action and effect from the viewpoint of design are surely exhibited by being driven and used under the service conditions or conditions corresponding to the service conditions, and the operation thereof is guaranteed.

However, the profiling float 10 according to the present invention is driven at an extremely low rotational speed by a direct current driving means driven by an extremely low driving voltage compared with the general service conditions as already described above, and so the service conditions thereof are greatly different, and the profiling float may be said to be used under extremely particular conditions. According to the profiling float 10 of the present invention, the gear pump 20 is used in such an extremely particular mode, whereby the state of the fluid for control of buoyancy transferred in the communicating passage can be minutely and surely controlled to easily control the movement of the profiling float, and moreover the electric power consumed can be reduced, and so a long service life is imparted to the profiling float.

According to the buoyancy controlling mechanism of the construction already described above, the control of the buoyancy of the profiling float by transferring the fluid for control of buoyancy can be executed in a wide range. Accordingly, other various sensors can be installed in the profiling float.

According to the usage of the profiling float according to the present invention, the profiling float can be moved with high accuracy to an expected target depth related to various parameter values obtained by the sensors installed therein.

Although the profiling float according to the present invention has been described specifically above, various changes or modifications may be added thereto.

For example, the valve mechanism may have construction that the opening and closing states in the communicating passage can be changed over stepless-wise or stepwise. According to such construction, the volume control of the bladder can be executed with high accuracy.

It is not essential to use the profiling float according to the present invention in the sea, and the float may also be used in fresh water such as water in a lake.

The invention claimed is:

1. A profiling float comprising:

a float chamber which has an airtight internal space, and which includes a semi-spherical dome integrally formed on a top portion of a spherical body, a diameter of the spherical body being greater than a diameter of the semi-spherical body, a diameter of the spherical body being greater than a diameter of the semi-spherical dome, a fluid storage part provided in the float chamber and storing a fluid for control of buoyancy, a bladder provided at an exterior of the float chamber, wherein the fluid for control of buoyancy is fillable in an interior of the bladder to change a volume thereof, thereby controlling buoyancy acting on the profiling float, a pump mechanism for transferring the fluid for control of buoyancy between the bladder and the fluid storage part, and a driving source for driving the pump mechanism, wherein the pump mechanism comprises a gear pump.

2. The profiling float according to claim 1, further comprising a valve mechanism for controlling the transfer of the fluid for control of buoyancy between the fluid storage part and the bladder.

3. The profiling float according to claim 1, wherein the gear pump has a performance-guaranteed driving speed of 10 to 150 revolutions/mm.

4. The profiling float according to claim 1, wherein the gear pump has a fluid transferring capacity of 4.5 to 100 cc/mm.

5. The profiling float according to claim 1, wherein the driving source of the pump mechanism comprises a direct current motor.

6. The profiling float according to claim 1, wherein the fluid for control of buoyancy has a viscosity of at least 3,000 cst at 2° C.

7. The profiling float according to claim 1, further comprising measuring means for measuring pressure and at least one water-related information.

8. The profiling float according to claim 7, wherein the measuring means can measure meteorological information.

9. The profiling float according to claim 7, wherein an amount of the fluid for control of buoyancy within the bladder is controlled based on at least the pressure information obtained by the measuring means.

10. The profiling float according to claim 2, wherein the gear pump has a performance-guaranteed driving speed of 10 to 150 revolutions/mm.

11. The profiling float according to claim 2, wherein the gear pump has a fluid transferring capacity of 4.5 to 100 cc/mm.

12. The profiling float according to claim 3, wherein the gear pump has a fluid transferring capacity of 4.5 to 100 cc/mm.

13. The profiling float according to claim 2, wherein the driving source of the pump mechanism comprises a direct current motor.

14. The profiling float according to claim 3, wherein the driving source of the pump mechanism comprises a direct current motor.

15. The profiling float according to claim 4, wherein the driving source of the pump mechanism comprises a direct current motor.

16. The profiling float according to claim 2, further comprising measuring means for measuring pressure and at least one water-related information.

17. The profiling float according to claim 16, wherein the measuring means can measure meteorological information.

18. The profiling float according to claim 3, further comprising measuring means for measuring pressure and at least one water-related information.

19. The profiling float according to claim 18, wherein the measuring means can measure meteorological information.

20. The profiling float according to claim 8, wherein an amount of the fluid for control of buoyancy within the bladder is controlled based on at least the pressure information obtained by the measuring means.

* * * * *